United States Patent [19]

Rasmussen et al.

[11] 4,094,628

[45] June 13, 1978

[54] ROTARY DRUM

[75] Inventors: Poul Rasmussen; Helge Carl Christian Kartman, both of Copenhagen, Denmark

[73] Assignee: F. L. Smith & Co., Cresskill, N.J.

[21] Appl. No.: 650,920

[22] Filed: Jan. 21, 1976

[30] Foreign Application Priority Data

Jan. 22, 1975 United Kingdom ..... 2842/75

[51] Int. Cl.[2] ..... F27D 15/02; F27B 7/14

[52] U.S. Cl. ..... 432/80; 432/103; 432/118

[58] Field of Search ..... 432/3, 80, 103, 106, 432/118

[56] References Cited

U.S. PATENT DOCUMENTS

| | | | |
|---|---|---|---|
| 2,132,709 | 10/1938 | Vanderwerp | 432/80 |
| 3,271,018 | 9/1966 | Reaney et al. | 432/118 |
| 3,384,356 | 5/1968 | Durinck | 432/103 |
| 3,441,259 | 4/1969 | Heyer et al. | 432/118 |
| 3,502,139 | 3/1970 | Andersen | 432/80 |
| 3,807,936 | 4/1974 | Vering | 432/118 |
| 3,910,756 | 10/1975 | Henning | 432/118 |
| 4,008,995 | 2/1977 | Mollenkopf et al. | 432/80 |

*Primary Examiner*—John J. Camby
*Attorney, Agent, or Firm*—Pennie & Edmonds

[57] ABSTRACT

A rotary drum for treating materials comprises a drum shell having a generally tubular configuration wall and one or more unitary material treating members forming a portion of the wall. In a preferred embodiment, the drum shell comprises a plurality of ring-shaped sections mechanically joined together in axial alignment wherein at least one of the sections has a unitary material treating member forming a portion of the section wall. In typical applications the treating members are cast steel members and the remaining portions of the drum shell are predominantly plate steel.

The advantages of this drum include easier fabrication with a reduction in the extent of welding, avoidance of welding in inaccessible locations, elimination of abrupt changes in thickness and, in operation, a reduction of unwanted shearing stresses.

33 Claims, 6 Drawing Figures

ROTARY DRUM

BACKGROUND OF THE INVENTION

1. Field of the Invention

This invention relates to rotary drums for treating materials; and, more particularly, to rotary drums having unitary material treating members forming a portion of the drum shell wall.

2. Description of the Prior Art

Rotary drums are used in a variety of industrial processes for treating liquid, pulverous and granular materials. Rotary kilns, for example, provide a familiar example of the use of such drums.

Rotary drums typically comprise a plurality of joined ring-shaped sections including one or more sections having material treating members such as scoops, cooling pipe supports and aperture coamings, extending radially inwardly or outwardly to facilitate treating or advancing the material. The ring-shaped sections are typically made of rolled and welded steel plate, and there is relatively little difference between the sections containing the material treating members and the remaining sections, except that the former may be made of an increased thickness plate for greater strength and rigidity.

The material treating members do not form a part of the wall but rather are attached to an already formed wall. Typically, these members are made of steel plate parts welded to one another and to the shell plate. Alternatively, they may comprise castings welded to the internal or external surfaces of one or more of the shell plates.

There are serious problems associated with the manufacture and use of the material treating members of these drums. The welded treating members are very difficult to fabricate. They typically require very complex welding operations at locations which are nearly inaccessible, e.g., the space beneath and between the tubes of a planetary cooler. In addition, the welded seams in these treating members often produce undesirable shearing stresses and, as a result, a weakening of the welded joints.

Drums with cast treating members attached to the wall have also been difficult to fabricate. The abrupt changes in thickness at the juncture between the rolled shell plates and the cast members has required the use of very high preheating temperatures with the consequence that manual welding is impractical.

SUMMARY OF THE INVENTION

In accordance with the invention, a rotary drum for treating materials comprises a drum shell having a generally tubular configuration wall and one or more unitary material treating members forming a portion of the wall. In a preferred embodiment, the drum shell comprises a plurality of ring-shaped sections mechanically joined together in axial alignment wherein at least one of the sections has a unitary material treating member forming a portion of the section wall. In typical applications, the treating members are cast steel members and the remaining portions of the drum shell are predominantly rolled plate steel.

The advantages of this drum include easier fabrication with a reduction in the extent of welding, avoidance of welding in inaccessible locations, elimination of abrupt changes in thickness and, in operation, a reduction of unwanted shearing stresses.

BRIEF DESCRIPTION OF THE DRAWING

The advantages, nature and various features of the invention will appear more fully upon consideration of the illustrative embodiments now to be described in detail in connection with the accompanying drawing in which.

For convenience of reference, corresponding structural elements are denoted by the same reference numeral throughout the drawing.

DETAILED DESCRIPTION

Figure 1:
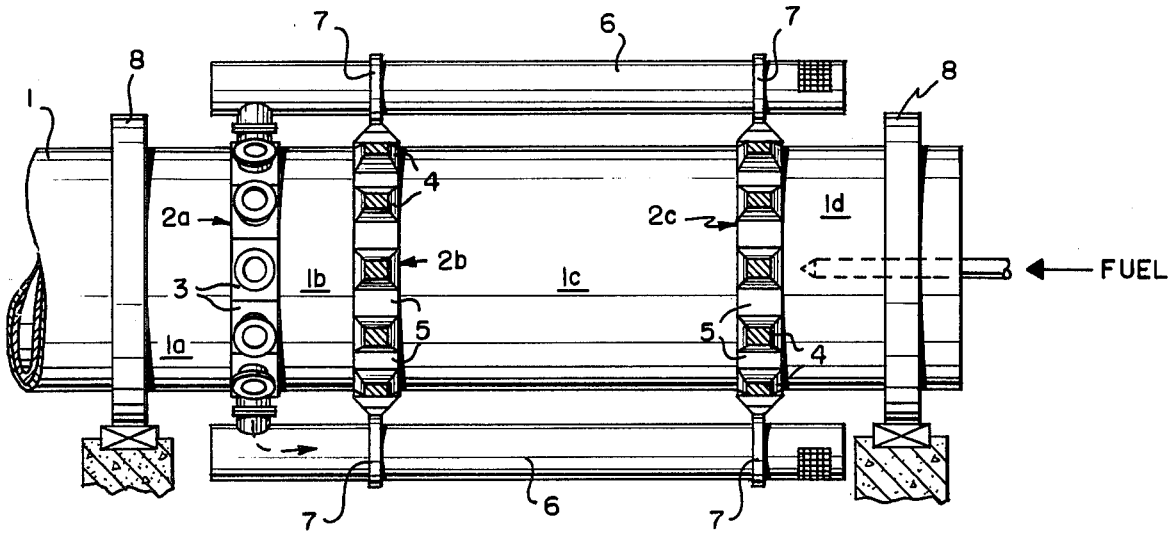
FIG. 1 is a schematic side view of one end of a rotary drum in accordance with the invention illustratively shown as the outlet end of a rotary kiln.

Referring to the drawings, FIG. 1 illustrates a rotary drum in accordance with the invention illustratively shown as the outlet end of a rotary kiln. Rotary drum 1 is comprised of ring-shaped sections 1*a*, 1*b*, 1*c* and 1*d*, each of shaped metal plate such as rolled steel, and one or more ring-shaped sections 2*a*, 2*b* and 2*c*, each containing at least one unitary material treating member forming a portion of the drum wall and the section wall. The term unitary material treating member as used herein refers broadly to any member having a circumferential portion forming part of the drum wall and a radially portion extending in the radial direction to facilitate the treatment or advancement of material. It includes unitary support members upon which further radial projections can be mounted.

Each of the ring-shaped sections is joined to its adjacent sections on either side as by welding along circumferential cross seams. The elements of the individual sections are joined together as by welding along longitudinal seams.

Ring-shaped section 2*a* comprises a plurality of unitary aperture members 3 each mechanically joined along its edges, as by welding, to the remainder of the section 2*a* and to the adjacent sections 1*a* and 1*b* on either side of section 2*a*. These aperture sections, which are preferably made of cast steel, permit material to be discharged from the drum into cooler tubes 6 along a path indicated by arrow. For the sake of clarity, only two of the cooler tubes are shown but the others are evenly distributed around the drum periphery in planetary fashion.

Ring-shaped sections 2*b* and 2*c* comprise a plurality of unitary support base members. In this particular embodiment, each ring-shaped section 2*b* and 2*c* is composed alternatively of support base members 4 and shaped metal plate elements 5. The respective elements are mechanically joined together along their edges and to the edges of adjacent sections as by welding. Preferably the support base members are made of cast steel and the shaped metal plates are rolled plate steel. The support base members 4 act as the bases for supports 7 of the cooler tubes 6.

The rotary drum is rotatably supported by live rings 8; and, in application as a kiln, a burner pipe (undesignated) projects into one end.

Figure 2:
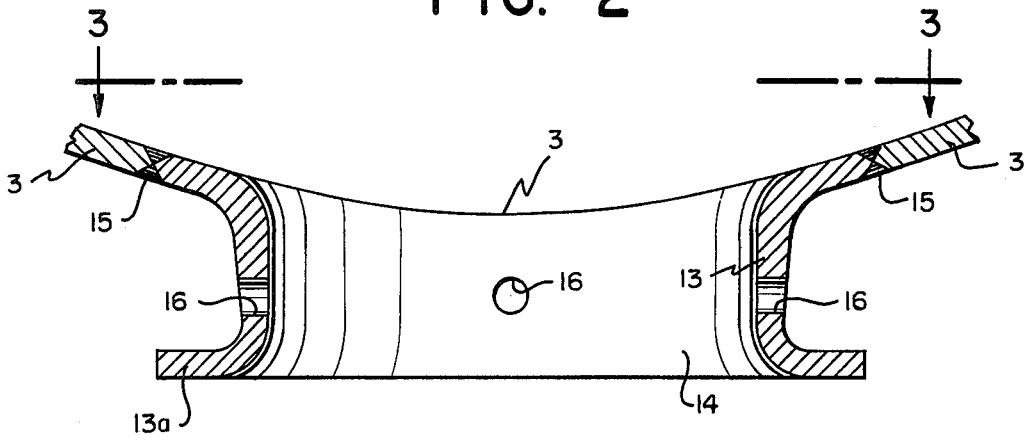
FIG. 2 is a cross-section showing a section of the rotary drum of FIG. 1 which includes a material treating member comprising an aperture member.
Figure 3:
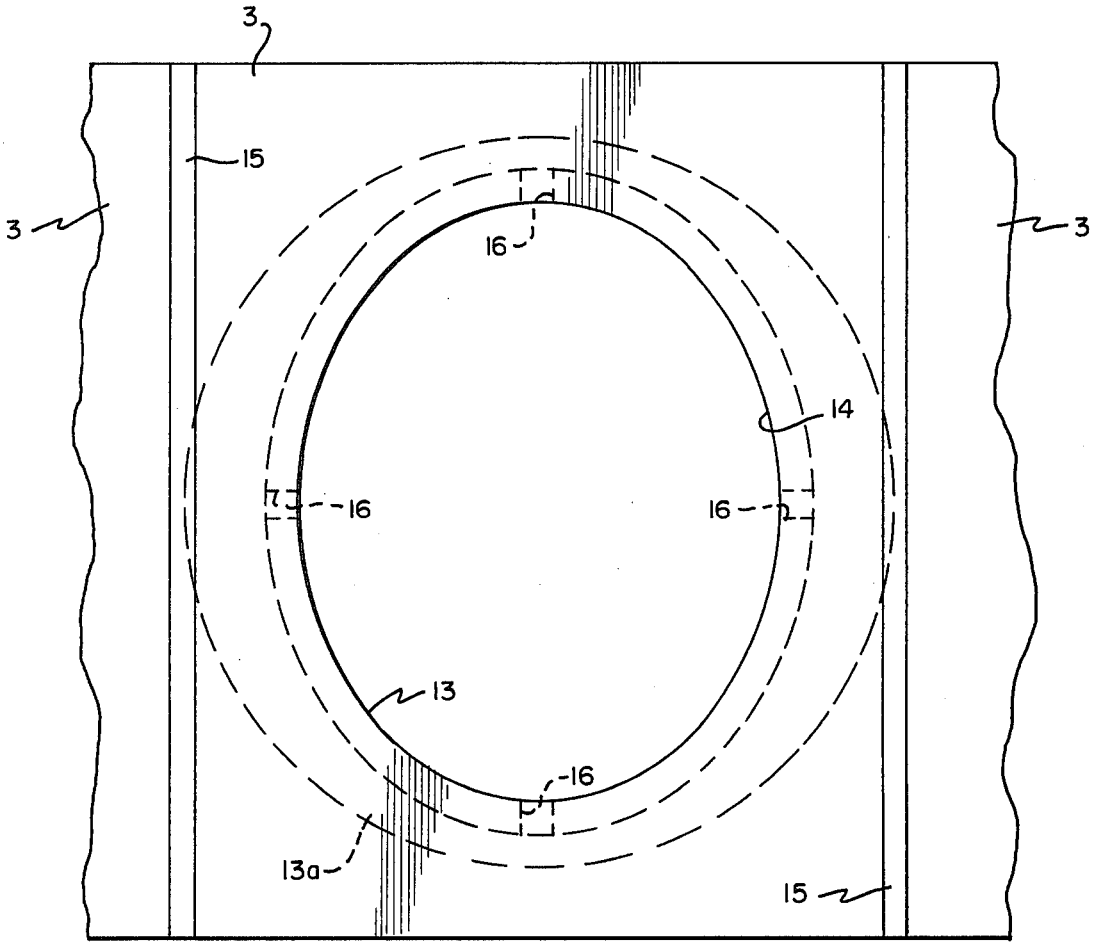
FIG. 3 is a section taken on the line 3—3 in FIG. 2 to further illustrate the features of the aperture member.

FIGS. 2 and 3 illustrate in greater detail the features of a material treating member providing a coamed aperture and utilized as the outlet members in ring-shaped section 2*a* of FIG. 1. Each outlet member is a unitary member comprising a circumferential portion 3 and a radially projecting coaming portion 13 surrounding a round or oval aperture 14. The circumferential portion 3 is preferably in the form of a curved rectangular plate having a curvature in the circumferential direction corresponding to that of the drum and a longitudinal dimension corresponding to the longitudinal width of the associated ring-shaped section. In preferred embodiments, the coaming 13 includes a circular flange 13*a* as illustrated by the dotted line circle in FIG. 3. The aperture member is preferably made of cast steel and is joined to the remaining portion of its associated section by welding respective edges along longitudinal seams 15 and to adjacent sections by welding respective edges along circumferential seams. The coaming 13 may be provided with holes 16 for permitting the attachment by bolts of a lining pipe (not shown) coupled to aperture 14.

In application, the flange of an outlet pipe (not shown) may be welded, riveted or bolted to flange 13*a*.

Figure 4:
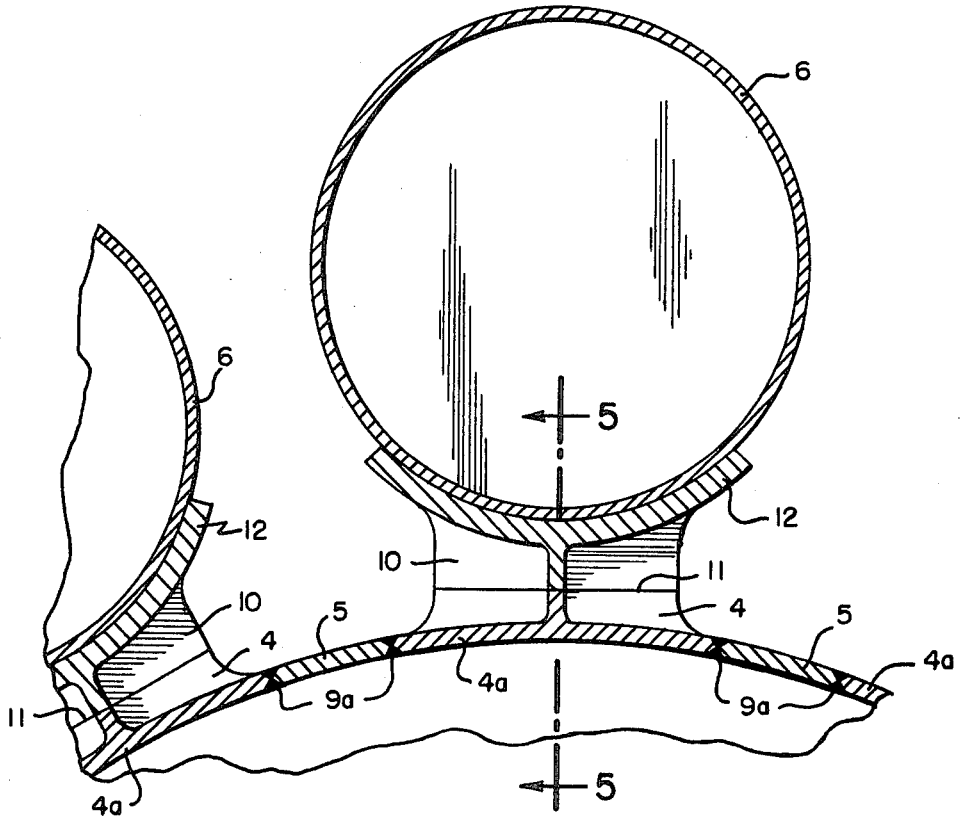
FIG. 4 is a cross-section of the rotary drum of FIG. 1 which includes a material treating member comprising a cooler tube support base.
Figure 5:
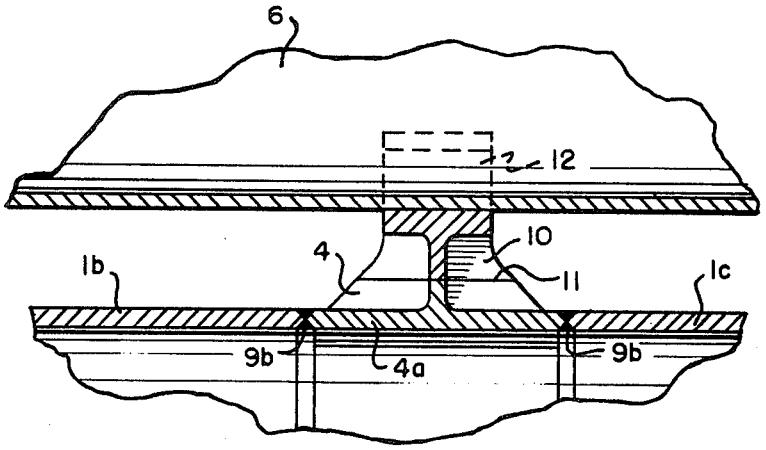
FIG. 5 is a longitudinal section taken on the line 5—5 in FIG. 4.

FIGS. 4 and 5 illustrate in greater detail the features of a material treating member providing a support base for the cooler tubes 6 and utilized as the support base members in ring-shaped sections 2*b* and 2*c* of FIG. 1. The unitary support base member 4 comprises a circumferential portion 4*a* in the form of a curved rectangular plate and radially projecting base portions 4. The circumferential portion 4*a* has a curvature corresponding to that of the drum.

An upper support member 10 is shown attached to the support base as by welding aling the surfaces 11. Alternatively, the upper support member could be attached by providing both the support base and the upper support with corresponding flanges and bolting or riveting. The upper support member includes a flange 12 curved to permit nesting of tube 6.

The support base 4 is a unitary member preferably of cast steel. If forms a portion of the drum wall and is preferably joined to the remaining portion of the drum wall as by welding longitudinal seams 9*a* along its longitudinal edges and circumferential cross seams 9*b* between its edges and the respective edges of adjacent sections on either side.

Figure 6:
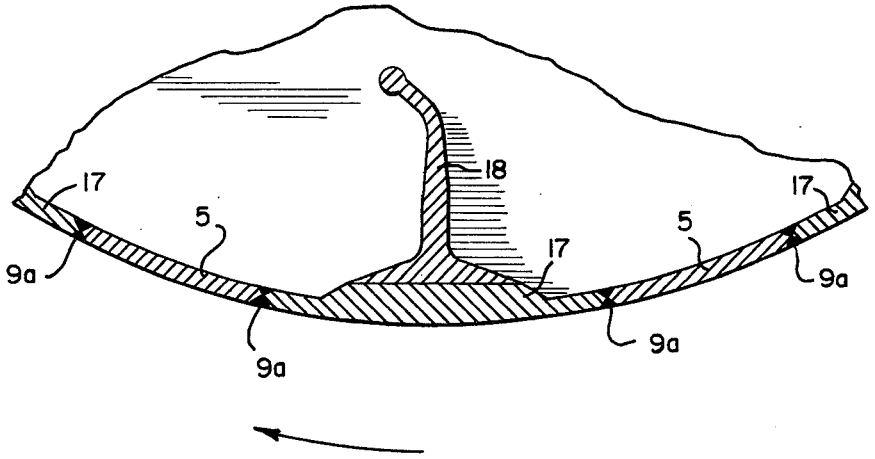
FIG. 6 is a cross-section of the rotary drum of FIG. 1 which includes a material treating member comprising a scoop support base.

FIG. 6 shows in detail the features of a material treating element which forms a unitary support base 17 for a scoop member 18 mounted inside a rotary drum for advancing material through the drum during rotation of the drum. The support base includes a circumferential portion forming a portion of the drum wall and a radially projecting portion providing support for scoop 18. The support base member is joined to the remaining portion of the drum wall as by welded seams along its edges 9*a*. Both support base 17 and scoop member 18 are preferably cast steel, and adjacent elements 5 may be rolled steel plate. The arrow indicates the direction of drum rotation.

A number of significant advantages accrue from this combination of drum wall and material treating members. The extent of welding is substantially reduced. In addition, the necessity of welding at inaccessible points is avoided, and the risk of producing undesired shearing stresses is reduced. The use of cast members rather than rolled and welded members avoids sharp variations in thickness, permitting freer scope for selecting thickness of material, which further reduces the risk of damaging stresses. The required welding is limited to welding electroslag seams between the individual elements of a shell section and between adjacent sections. Suich electroslag welds are relatively easy to perform and control; and they permit the intense preheating of plate material and cast material. In addition, the cast parts may be made with smoother and more uniform transitions between materials of different thickness so that the heat stresses to which the material is subjected are reduced. Finally, it is possible to prefabricate divided shell sections corresponding to a fraction of the shell circumference (e.g. one-third or one-fourth), thereby reducing the welding required during installation.

A shell section as described above may consist of cast elements alternating with rolled plate elements or exclusively of cast elements, depending on the circumstances. Further, the cast element, or at least one of the cast elements, may form a coaming surrounding an aperture in the element. In use, such an aperture allows material to pass through the shell wall.

If the drum is a rotary kilm or a cooler drum a cast coaming surrounding an aperture may act as a coupling for a pipe leading from the drum shell to a cooler tube mounted on the outside of the shell. In addition, the cast element, or at least one of the cast elements, can form at least part of the support for a cooler tube mounted on the outside of the drum shell. Alternatively, the cast element may act as a lifter or scraper within the shell or as a support for such a lifter or scraper.

While the invention has been described in connection with a small number of specific embodiments, it is to be understood that these embodiments are merely illustrative of the many possible specific embodiments which can represent applications of the principles of the invention. Thus, numerous and varied other devices can be made by those skilled in the art without departing from the spirit and scope of the present invention.

What is claimed is:

1. A rotary drum for treating materials comprising:

a drum shell having a generally tubular configuration wall;

one or more material treating members, each comprising a unitary member having a circumferential portion which forms a portion of said wall and a generally radial portion integral therewith and projecting radially inwardly or outwardly from said wall; and means secured to said radial portion for supporting a cooler tube or for facilitating the direct advancement of said materials.

2. The rotary drum according to claim 1 wherein said one or more material treating members comprise cast metal members and the remaining portion of said drum shell is predominantly comprised of shaped metal plate material.

3. The rotary drum according to claim 1 wherein said one or more material treating members comprise cast steel members and the remaining portion of said drum shell is predominantly comprised of rolled steel plate.

4. The rotary drum according to claim 1 wherein said one or more material treating members each have a circumferential portion characterized by a curvature corresponding to that of the drum wall, have boundaries defined by edges, and are mechanically joined to the remaining portion of said drum wall along the edges.

5. The rotary drum according to claim 1 wherein:

said one or more material treating members comprise cast steel members each having a circumferential portion characterized by a curvature corresponding to that of the drum shell and have boundaries defined by edges;

the remaining portion of said drum shell is predominantly comprised of rolled steel plate; and said one or more material treating members are mechanically joined to said remaining portion of said drum shell by welding edges of said members to edges defining corresponding openings in said remaining portion of the drum shell.

6. The rotary drum according to claim 1 wherein said one or more material treating members include at least one cooler tube support base.

7. The rotary drum according to claim 6 wherein the cooler tube supporting means comprises a support member having an end attached to said support base and having its other end attached to said cooler tube.

8. The rotary drum according to claim 1 wherein said one or more material treating members include at least one aperture and said cooler tube supporting means includes a coaming surrounding said aperture and extending generally radially from the shell wall.

9. The rotary drum according to claim 1 wherein said one or more material treating members include at least one scoop member support base.

10. The rotary drum according to claim 9 wherein the material advancing means comprises a scoop member attached to said support base and projecting inwardly.

11. A rotary drum for treating, materials comprising a plurality of ring-shaped sections, each having a circumferential wall mechanically joined together in axial alignment to form a drum shell having a generally tubular configuration wall; and one or more of said ring-shaped sections having at least one associated material treating member, said treating member comprising a unitary member having a circumferential portion forming a portion of said shell wall and a radial portion projecting radially inwardly or outwardly from said shell wall; and means secured to said radial portion for supporting a cooler tube or for facilitating the direct advancement of materials in said rotary drum.

12. The rotary drum according to claim 11 wherein said material treating members comprise cast metal members and the remaining portion of said drum shell is predominantly comprised of shaped metal plate material.

13. The rotary drum according to claim 11 wherein said material treating members comprise cast steel members and the remaining portion of said drum shell is predominantly comprised of rolled steel plate.

14. The rotary drum according to claim 11 wherein each of the material treating members comprises a cast metal member and the remaining portion of the ring-shaped section which includes said members is predominantly shaped metal plate.

15. The rotary drum according to claim 11 wherein:

at least one of said material treating members has a circumferential portion characterized by a curvature corresponding to that of the drum, an axial dimension corresponding to that of said ring-shaped section, and boundaries defined by edges; and said material treating member is mechanically joined at the edges to the edges of the remaining portion of its associated ring-shaped section and to the edges of the two ring-shaped sections immediately adjacent said associated section.

16. The rotary drum according to claim 11 wherein at least one said material treating member comprises a cooler tube support base.

17. The rotary drum according to claim 16 wherein the cooler tube supporting means comprises a support member having an end attached to said support base and having its other end attached to said cooler tube.

18. The rotary drum according to claim 11 wherein said at least one material treating member defines at least one aperture having a generally radially projecting coaming which surrounds said aperture.

19. The rotary drum according to claim 11 wherein at least one said material treating member comprises a scoop member support base.

20. The rotary drum according to claim 19 wherein the material advancing means comprises a scoop member attached to said support base and projecting inwardly.

21. In a rotary kiln of the type comprising a rotary drum having a generally tubular configuration drum shell wall, means for rotatably supporting said drum; one or more cooler tubes for receiving material from said drum; and one or more apertures for permitting material to pass from said drum into said cooler tube, the improvement wherein:

said rotary drum includes at least one material treating member forming a portion of its wall, said treating member comprising a unitary member having a circumferential portion forming a portion of said drum wall and a radial portion projecting radially inwardly or outwardly from said wall, and means being provided for supporting one or more of said cooler tubes upon said rotary drum or for facilitating the direct advancement of material in said drum.

22. The rotary kiln according to claim 21 wherein said material treating member defines an aperture having a coaming extending about the periphery and radially from said wall.

23. The rotary kiln according to claim 21 wherein said material treating member comprises a cooler tube support base.

24. The rotary drum according to claim 23 wherein the cooler tube supporting means comprises a support member having an end attached to said support base and having its other end attached to said cooler tube.

25. The rotary kiln according to claim 21 wherein said material treating member comprises a scoop member support base.

26. The rotary kiln according to claim 25 wherein the material advancing means comprises a scoop member attached to said support base and projecting inwardly.

27. A rotary drum for treating materials comprising:

a drum shell having a generally tubular configuration wall; and one or more material treating members forming a portion of said wall, said treating members each comprising a unitary member having a circumferential portion of said wall and a radial portion projecting radially inwardly or outwardly from said wall for facilitating the treatment or advancement of said materials, and said one or more material treating members including at least one aperture member having a radially projecting coaming surrounding an aperture.

28. A rotary drum for treating materials comprising a plurality of ring-shaped sections, each having a circumferential wall mechanically joined together in axial alignment to form a drum shell having a generally tubular configuration wall; and one or more of said ring-shaped sctions having at least one material treating member forming a portion of the shell wall, said treating member comprising a unitary member having a circumferential portion forming a portion of said shell wall and a radial portion projecting radially inwardly or outwardly from said shell wall for facilitating the treatment or advancement of materials in said rotary drum, and at least one of said material treating member being an aperture member having a radially projecting coaming surrounding an aperture.

29. In a rotary kiln of the type comprising a rotary drum having a generally tubular configuration drum shell wall, means for rotatably supporting said drum; one or more cooler tubes for receiving material from said drum; one or more apertures for permitting material to pass from said drum into said cooler tube, and one or more cooler tube support members for attaching said cooler tube onto said rotary drum, the improvement wherein:

said rotary drum includes at least one material treating member forming a portion of its wall, said treating member comprising a unitary member having a circumferential portion forming a portion of said drum wall and a radial portion projecting radially inwardly and outwardly frm said wall for facilitating the treatment or advancement of material in said drum, and said material treating member comprising an aperture member having a radially projecting coaming surrounding an aperture.

30. A rotary drum for treating materials comprising:

a drum shell having a generally tubular configured wall;

one or more material treating members, each comprising a unitary cast steel member having a circumferential portion which forms a portion of said wall and having a radial portion which projects outward and defines an aperture with a radially projecting coaming surrounding the aperture, each treating member having a circumferential portion characterized by a curvature corresponding to that of the drum wall and having boundaries defined by edges and being mechanically joined to the remaining portion of said drum wall along the edges.

31. The rotary drum according to claim 30 wherein said one or more unitary treating members form a portion of an annular section of said drum wall.

32. The rotary drum according to claim 30 wherein said unitary treating members are joined together to form an annular section of said drum wall.

33. A rotary drum having an elongate, cylindrical casing provided with planetary cooling tubes spaced circumferentially about said casing, and attaching means for attaching each of said tubes to said casing, said attaching means comprising at least one annulus welded into and constituting a longitudinal section of said casing, said annulus having an internal diameter corresponding to that of said casing and having a wall thickness at least as great as that of said casing, a mounting member carried by each of said cooling tubes, each of said mounting members having a predetermined width in a direction axially of said casing, and supporting means extending radially outwardly of said annulus and being secured to the latter and to each of said mounting member, each of said supporting means consisting of a pair of generally transverse members which intersect each other generally medially along their length.

* * * * *

UNITED STATES PATENT AND TRADEMARK OFFICE

CERTIFICATE OF CORRECTION

PATENT NO. : 4,094,628

DATED : June 13, 1978

INVENTOR(S) : Poul Rasmussen and Helge Carl Christian Kartman

It is certified that error appears in the above-identified patent and that said Letters Patent are hereby corrected as shown below:

Column 3, line 43, "aling the surfaces" should read
-- along the surfaces --

Column 3, line 50, "If forms a portion" should read
-- It forms a portion --

Column 5, line 39, after "treating" delete the comma

Column 7, line 39, (Claim 29, line 15) "outwardly frm said" should read
-- outwardly from said --

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*